US008432355B2

(12) United States Patent
Johnson et al.

(10) Patent No.: US 8,432,355 B2
(45) Date of Patent: Apr. 30, 2013

(54) IN-PLANE SWITCHING DISPLAY DEVICES

(75) Inventors: Mark Thomas Johnson, Eindhoven (NL); Alwin Rogier Martijn Verschueren, S-Hertogenbosch (NL); Martinus Hermanus Wilhelmus Maria Van Delden, Eindhoven (NL); Sander Jurgen Roosendaal, Brno (CS); Kars-Michiel Lenssen, Veldhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 946 days.

(21) Appl. No.: 12/090,133

(22) PCT Filed: Sep. 14, 2006

(86) PCT No.: PCT/IB2006/053289

§ 371 (c)(1),
(2), (4) Date: Apr. 14, 2008

(87) PCT Pub. No.: WO2007/042950

PCT Pub. Date: Apr. 19, 2007

(65) Prior Publication Data

US 2008/0238868 A1 Oct. 2, 2008

Related U.S. Application Data

(60) Provisional application No. 60/726,854, filed on Oct. 14, 2005.

(51) Int. Cl.
*G09G 3/34* (2006.01)

(52) U.S. Cl.
USPC ..... 345/107; 359/296

(58) Field of Classification Search ..... 345/107, 345/1.1–111, 156–184, 204–215, 690–699; 359/296

See application file for complete search history.

(56) References Cited

U.S. PATENT DOCUMENTS

| | | | | |
|---|---|---|---|---|
| 6,639,580 | B1 | 10/2003 | Kishi | |
| 6,900,924 | B2 * | 5/2005 | Goden | 359/296 |
| 7,145,547 | B2 * | 12/2006 | Johnson | 345/107 |
| 7,227,525 | B2 * | 6/2007 | Kishi | 345/107 |
| 7,283,119 | B2 * | 10/2007 | Kishi | 345/107 |
| 2003/0011869 | A1 * | 1/2003 | Matsuda et al. | 359/296 |
| 2003/0231162 | A1 * | 12/2003 | Kishi | 345/107 |
| 2004/0184136 | A1 * | 9/2004 | Goden | 359/296 |
| 2004/0239613 | A1 * | 12/2004 | Kishi | 345/107 |
| 2006/0279525 | A1 * | 12/2006 | Matsuda | 345/107 |

FOREIGN PATENT DOCUMENTS

| | | | |
|---|---|---|---|
| WO | WO2005071650 | A1 | 8/2005 |
| WO | WO2005093706 | A1 | 10/2005 |

* cited by examiner

*Primary Examiner* — Lun-Yi Lao
*Assistant Examiner* — Gene W Lee
(74) *Attorney, Agent, or Firm* — Larry Liberchuk

(57) ABSTRACT

A drive method is provided for a display device using the movement of 5 charged particles with a pixel area, with each pixel having first and second drive electrodes (20,23; 22) and a pixel electrode (26). The method comprises a reset phase to move the particles in each pixel towards the first drive electrode (20,23), a pixel data loading phase, to cause selected particles either to stay in the vicinity of the first drive electrode (20,23) or move towards the 10 pixel electrode (26), and a drive phase to distribute the particles which have moved towards the pixel electrode over the pixel electrode (26). The address phase is line-by-line but can be made short, and the other phases can be carried out in parallel for all pixels, saving time.

7 Claims, 9 Drawing Sheets

IN-PLANE SWITCHING DISPLAY DEVICES

This invention relates to display devices, in particular in plane switching electrophoretic display devices.

Electrophoretic display devices are one example of bistable display technology, which use the movement of particles within an electric field to provide a selective light scattering or absorption function.

In one example, white particles are suspended in an absorptive liquid, and the electric field can be used to bring the particles to the surface of the device. In this position, they may perform a light scattering function, so that the display appears white. Movement away from the top surface enables the colour of the liquid to be seen, for example black. In another example, there may be two types of particles, for example black negatively charged particles and white positively charged particles, suspended in a transparent fluid. There are a number of different possible configurations.

It has been recognised that electrophoretic display devices enable low power consumption as a result of their bistability (an image is retained with no voltage applied), and they can enable thin display devices to be formed as there is no need for a backlight or polariser. They may also be made from plastics materials, and there is also the possibility of low cost roll-to-roll processing in the manufacture of such displays.

For example, the incorporation of an electrophoretic display device into a smart card has been proposed, taking advantage of the thin and intrinsically flexible nature of a plastic substrate, as well the low power consumption.

If costs are to be kept as low as possible, passive addressing schemes are employed. The most simple configuration of display device is a segmented reflective display, and there are a number of applications where this type of display is sufficient. A segmented reflective electrophoretic display has low power consumption, good brightness and is also bistable in operation, and therefore able to display information even when the display is turned off.

However, improved performance and versatility is provided using a matrix addressing scheme. An electrophoretic display using passive matrix addressing typically comprises a lower electrode layer, a display medium layer, and an upper electrode layer. Biasing voltages are applied selectively to electrodes in the upper and/or lower electrode layers to control the state of the portion(s) of the display medium associated with the electrodes being biased.

FIG. 1 shows a known passive matrix display layout for generating perpendicular electric fields between the top column electrodes 10 and the bottom row electrodes 12. The electrodes are generally situated on two separate substrates.

The passive matrix electrophoretic display comprises an array of electrophoretic cells arranged in rows and columns and sandwiched between the top and bottom electrode layers. The column electrodes 10 are transparent.

The design of FIG. 1 has been disclosed, for example, in the article by R. C. Liang et al, in the Proceedings of $9^{th}$ International Display Workshop (IDW'02), page 1337-1340 (2002).

Cross bias is a problem in the design of passive matrix displays. Cross bias refers to the bias voltages applied to electrodes that are associated with display cells that are not in the scanning row (the row being updated with display data). For example, to change the state of cells in a scanning row in a typical display, bias voltages might be applied to column electrodes in the top electrode layer for those cells to be changed, or to hold cells in their initial state. Such column electrodes are associated with all of the display cells in their column, including the many cells not located in the scanning row.

Another type of electrophoretic display device uses so-called "in plane switching". This type of device uses movement of the particles selectively laterally in the display material layer. When the particles are moved towards lateral electrodes, an opening appears between the particles, through which an underlying surface can be seen. When the particles are randomly dispersed, they block the passage of light to the underlying surface and the particle colour is seen. The particles may be coloured and the underlying surface black or white, or else the particles can be black or white, and the underlying surface coloured.

An advantage of in-plane switching is that the device can be adapted for transmissive operation, or transflective operation. In particular, the movement of the particles creates a passageway for light, so that both reflective and transmissive operation can be implemented through the material. These displays can also provide bright full colour operation.

The in-plane electrodes may all be provided on one substrate, or else both substrates may be provided with electrodes. The need to avoid unnecessary cross-overs within the structure is a design limitation which has influenced the pixel design within this type of display device.

In the simplest implementation, each pixel is associated with two electrodes, but there are also designs using three electrodes per pixel; a pixel electrode, a row (select) electrode and a column (data) electrode. An example of such a three electrode pixel design is disclosed in U.S. Pat. No. 6,639,580. This also discloses the use of different heights to provide physical barriers to the movement of particles.

A problem with the passive matrix in-plane switching arrangements is the slow speed of response. This is due to the fact that with a passive matrix only one line at a time can be addressed, and that the particles have to travel a large in-plane distance (compared to the smaller top-down distance of electrophoretic displays using movement of particles in a direction perpendicular to the substrates). The image update time can extend to hours for a large display with many rows and columns of pixels.

This invention relates specifically to in-plane passive matrix switching display devices, and aims to provide pixel designs and drive methods which reduce the time required to update images.

According to the invention, there is provided a drive method for a display device, the display device comprising an array of rows and columns of pixels disposed over a common substrate, wherein each pixel comprises at least a first drive electrode, a second drive electrode and a pixel electrode, and wherein the display characteristics of each pixel are altered by controlling the movement of charged particles with the pixel area under the influence of control signals applied to the first and second drive electrodes and the pixel electrode, wherein the method comprises:

in a reset phase, applying control signals to all pixels such that the particles in each pixel move towards the first drive electrode;

in a pixel data loading phase, applying control signals to rows or columns of pixels in turn, such that the particles in each pixel are selected either to stay in the vicinity of the first drive electrode or move towards the pixel electrode;

in a drive phase, applying control signals to all pixels for distributing the particles which have moved towards the pixel electrode over the pixel electrode.

This drive scheme has three phases, but only one of these requires line-by-line addressing, and the others can be performed for all pixels in parallel. By minimizing the time required for the line-by-line phase, the overall addressing time can be reduced.

In the pixel data loading phase, the particles in each pixel can be selected either to stay in the vicinity of the first drive electrode or move to the pixel electrode, and in the drive phase the uniformity of the distribution of the particles which are in the vicinity of the pixel electrode can be increased. In this way, a high speed transfer of particles to the pixel electrodes can be implemented, and only in the final phase is the desired distribution of particles over the pixel electrodes obtained.

In another example, each pixel can further comprise a temporary storage electrode with the first and second drive electrodes on one side and the pixel electrode on an opposite side, and in the pixel data loading phase, the particles in each pixel can be selected either to stay in the vicinity of the first drive electrode or move to the temporary storage electrode, which is closer to the pixel electrode. In the drive phase, the pixels in the vicinity of the temporary storage electrode are then moved to the pixel electrode.

This arrangement uses the line-by-line addressing to selectively move particles to the temporary storage electrode. This can be a short distance, so that the time required is minimized. In the driving phase, the particles can be moved in parallel to the pixel electrodes.

In the drive phase, a signal can be applied to the second drive electrode to substantially prevent the movement of particles from the temporary storage electrode to the first drive electrode.

When no temporary storage electrode is used, in the drive phase, a signal can be applied to the second drive electrode which substantially prevents the movement of particles from the first drive electrode to the pixel electrode.

The different drive schemes thus enable particles to be moved to desired locations, and held there using electrical potentials acting as barriers.

In all examples, the pixel data loading phase can comprise multiple sub-phases for implementing partial movement of particles to provide grey scale operation.

The invention also provides a display device comprising an array of rows and columns of pixels disposed over a common substrate, wherein each pixel comprises:

a first drive electrode;

a temporary storage electrode; and a pixel electrode, wherein the temporary storage electrode faces the first drive electrode in one direction and faces the pixel electrode in another direction, and wherein the display characteristics of each pixel are altered by controlling the movement of charged particles within the pixel area under the influence of control signals applied to the first drive electrode, the pixel electrode and the temporary storage electrode, wherein the temporary storage electrode is operable to retain particles in its vicinity during an addressing phase, before permitting the particles to move to the pixel electrode in a final drive phase.

The use of the temporary storage electrode enables the line-by-line addressing phase to be shortened, as outlined above. The temporary storage electrode is effectively between the first drive electrode and the pixel electrode and acts as an intermediate storage location in the path of particles from the first drive electrode to the pixel electrode.

Each pixel may further comprise a second drive electrode, with the first and second drive electrodes on one side of the temporary storage electrode and the pixel electrode on the opposite side of the temporary storage electrode, and the first and second drive electrodes are associated with the data and select electrode. Frequently, select electrodes are associated with rows of pixels and data electrodes are associated with columns of pixels. This configuration is used in the embodiments of the invention below. It is also possible to associate the first and second drive electrodes with columns and rows respectively, or to make the first electrode a common electrode, and connect the temporary storage electrode as data electrode.

The second drive electrode can then be used to act as a barrier for the passage of particles from the first drive electrode to the temporary storage electrode.

Each pixel may further comprise a display medium including charged particles, and the electrodes and display medium are selected such that the charged particles only move in response to a voltage difference between electrodes which exceeds a threshold voltage.

This avoids the need for the second drive electrode, as the threshold arrangement can be used to prevent the movement of particles in given situations.

The display medium can be sandwiched between the first drive electrode and the temporary storage electrode.

The device may comprise an electrophoretic passive matrix display device.

Examples of the invention will now be described in detail with reference to the accompanying drawings, in which.

The same references are used in different Figures to denote the same layers or components, and description is not repeated.

Figure 1:
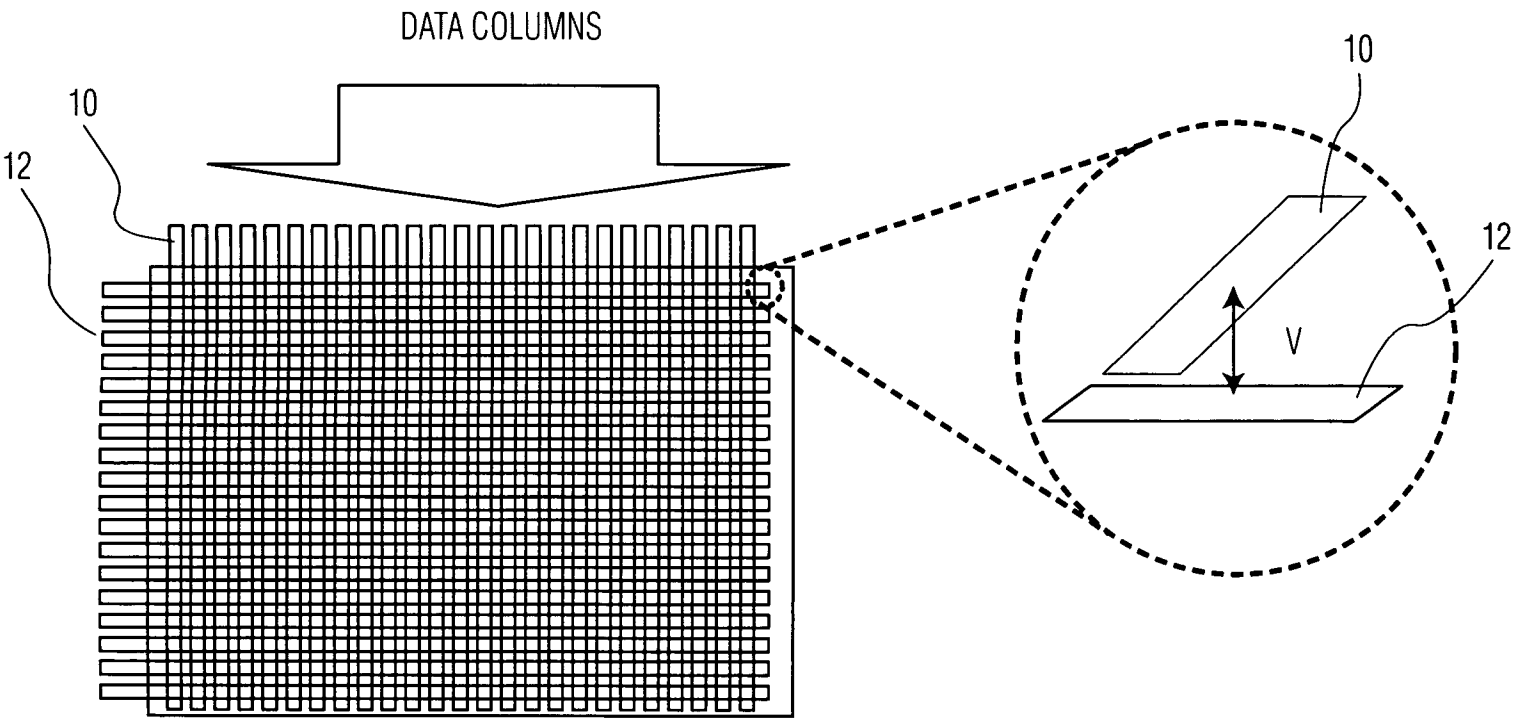
FIG. 1 PRIOR ART
FIG. 1 shows a known passive matrix display layout.
Figure 2:
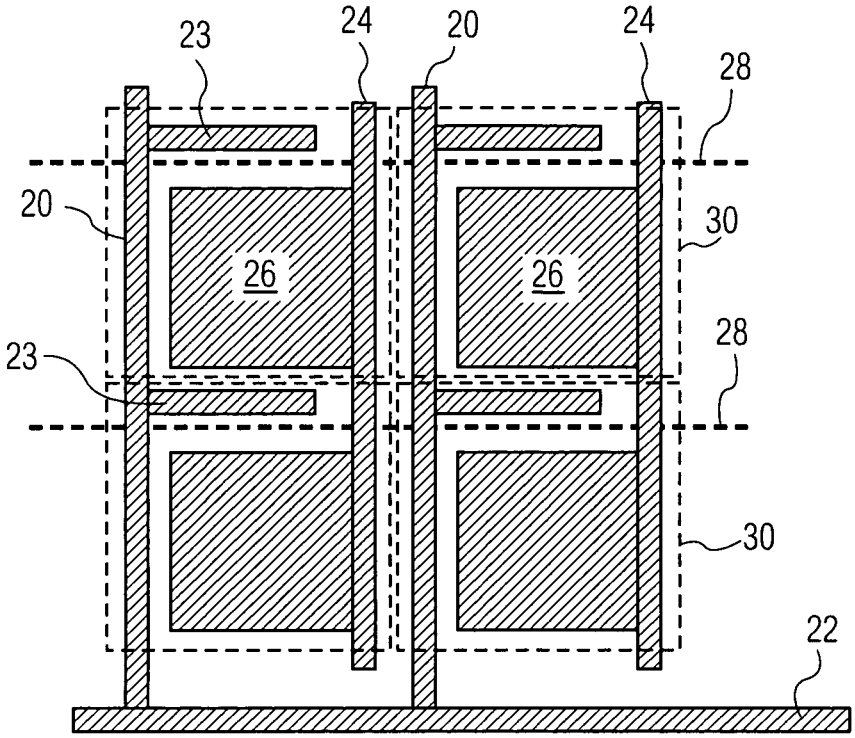
FIG. 2 shows an in-plane switching pixel layout proposed by the applicant and which can be controlled using the method of the invention.

FIG. 2 shows a first example of pixel layout which has been proposed by the applicant, and which can be operated in accordance with the method of the invention.

In FIG. 2, first column electrodes 20 connect to a common reservoir electrode 22. The column electrodes 20 include spurs 23. Second column electrodes (data electrodes) 24 connect to pixel electrodes 26, and gate/select electrodes 28 run in the row direction.

Each pixel thus comprises three electrodes. The pixel electrode is used to move the particles into the visible portion of the pixel, and for this reason the pixel electrode 26 occupies most of the pixel area. Each pixel area is shown in FIG. 2 as area 30, and the different pixel areas can be physically separated from each other The reservoir electrode 20,22,23 is used to move the particles laterally to the hidden portion of the pixel. The gate electrode 28 is used to prevent movement of the particles from the reservoir portion into the visible portion of the pixel in all lines other than the selected line, and thus enables row by row operation of the pixels.

As will be described below, the gate electrode 28 operates to interrupt the electric field between the reservoir electrode and the pixel electrode, so that a driving voltage on the pixel electrode only causes movement of particles for a selected row, for which the electric field is not interrupted.

This gate electrode 28 is required as a result of the passive addressing scheme, and is needed to provide different conditions to a selected row than to non-selected rows.

The pixel layout of FIG. 2 can be created without requiring any cross-over structures on either of the two substrates. This enhances the manufacturability of the structure, particularly if the device is to be made in a roll-to-roll manufacturing method.

The first substrate comprises the reservoir, data and pixel electrodes 20,23,24,26, and an opposing substrate is provided with the gate electrodes 28. The pixel electrodes 26 are all individually driven by data drivers. Optionally, pixel walls may be built up to surround every pixel to isolate pixels from each other, and the space between the substrates is filled with electrophoretic fluid.

A first aspect of the invention provides a drive scheme for the pixel layout of FIG. 2, and is explained with reference to FIGS. 3 to 8.

FIGS. 3 to 8 show the voltages applied to the three electrodes of the pixel design of FIG. 2, and show how the charged particles move. For explanation, the pixels of the left column are to be "written" which means that the particles are to be moved to the pixel electrode, whereas the pixels of the right column are to be "non written" which means that the particles are to stay in the reservoir, in the vicinity of the electrodes 23.

For explanation, the particles are assumed to have a negative charge, and the common reservoir electrode has a reference voltage of 0V for normal addressing.

Figure 3:
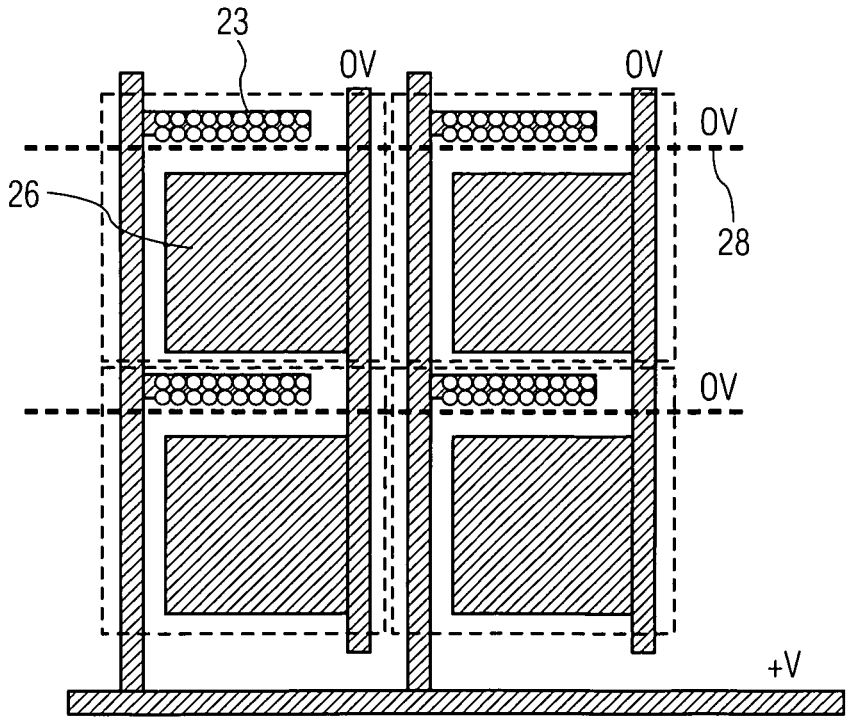
FIGS. 3 to 8 are used to show in sequence how the pixel layout of FIG. 2 is controlled in accordance with the method of the invention.

The first step, of FIG. 3, is to perform a global reset phase. This can be achieved by providing a high voltage on the reservoir electrodes 23 as shown (+V) with the other electrodes at 0V.

All gate electrodes are then set to a negative voltage (−V), and the reservoir electrodes are returned to the reference voltage, of 0V in this example. This prevents particles moving from the reservoir 23 to the pixel electrode and sets up a barrier to the movement of particles out of the reservoir.

Figure 4:
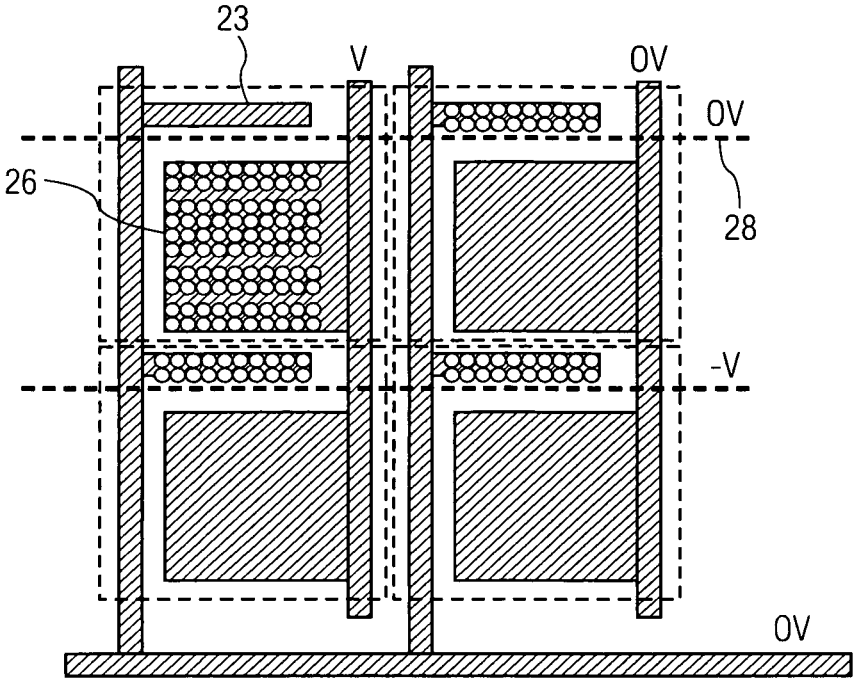
Figure 5:
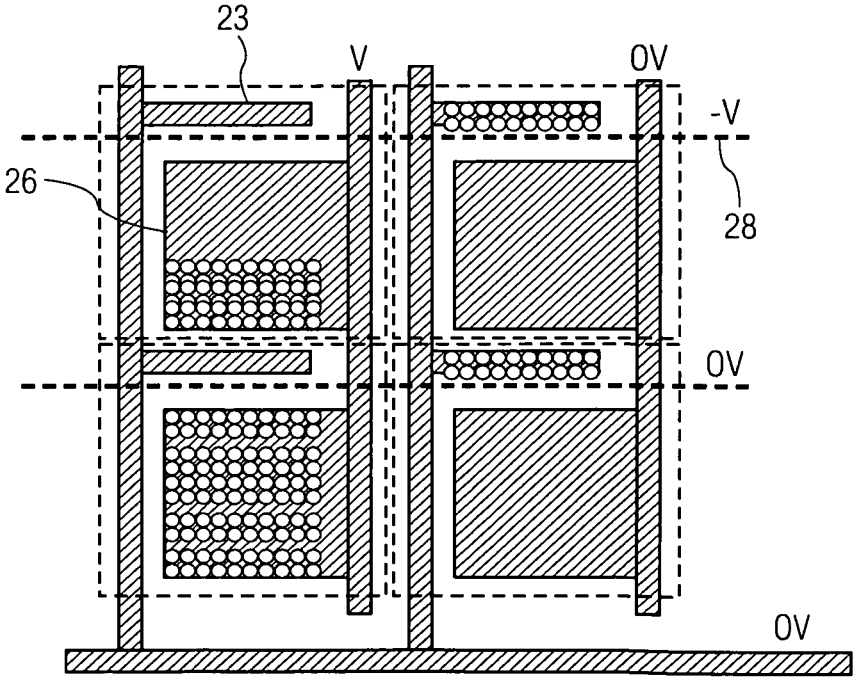

To perform the line by line addressing of the pixels, the voltage of the gate electrode 28 of the selected line is set to a less negative voltage, for example 0V. FIG. 4 shows the addressing of the top row, and FIG. 5 shows the addressing of the bottom row. When a line is selected, those pixel electrodes with a positive voltage cause particles to move into the pixel, whilst those pixels with pixel electrode voltage at 0V are not filled, as can be seen in FIG. 4. Thus, the data line (which connects to the pixel electrode 26) for a pixel which is to be written is provided with a positive voltage (V).

As can also be seen in FIG. 4, the gate electrode 28 for the non-selected row prevents any movement of particles, even for a data column which has the positive write voltage. In other words, the bottom left pixel of FIG. 4 is not yet written, because the row is not selected, and the gate electrode 28 acts as a barrier preventing the movement of the particles away from the electrode 23.

After pixel filling is completed, the gate electrode returns to a negative voltage, and the following line is selected and pixels of the next line are filled, if required. This is shown in FIG. 5.

At this point however, a problem occurs when the gate electrode 28 of the previous line returns to its non-select voltage, −V. This voltage will cause the particles moved into the pixel to be further displaced towards the edge of the pixel. As such, the pixel will partially loose its colour. The longer the non-select voltage (−V) is applied, the more the undesired particle motion will occur, and as a result, pixels which were addressed longer ago will have even more changed colours—resulting in a horizontal variation of the pixel colours. These effects are highly undesirable.

This effect is shown in FIG. 5, where the particles in the addressed top left pixel have bunched away from the top gate electrode (at −V) towards the lower reservoir electrode (at 0V).

Figure 6:
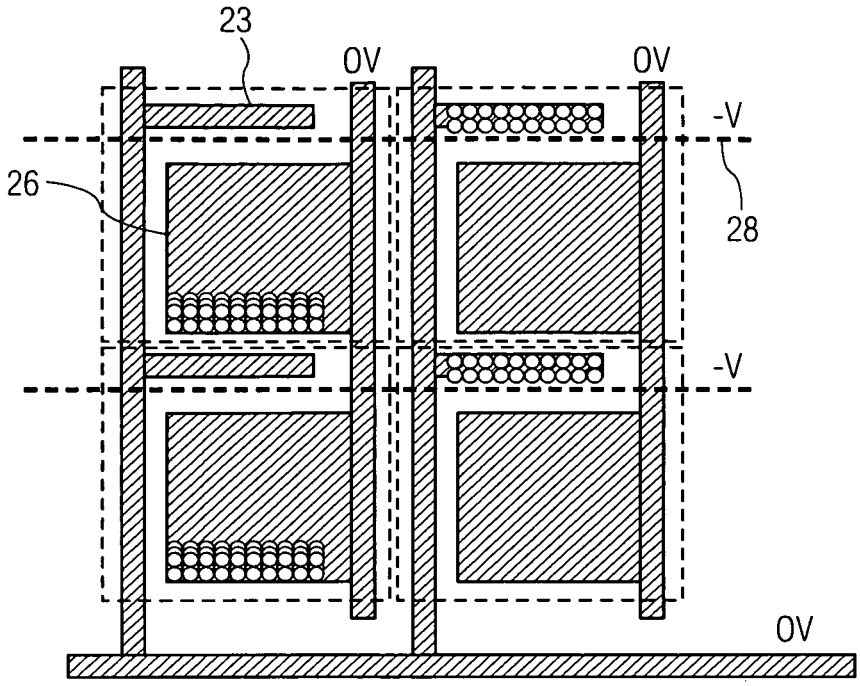

FIG. 6 shows that the same effect occurs after the next row has been addressed.

It is not possible to prevent this undesired motion within this simple pixel layout, but the invention provides a modification to the drive scheme to enable the particles to be distributed uniformly.

Figure 7:
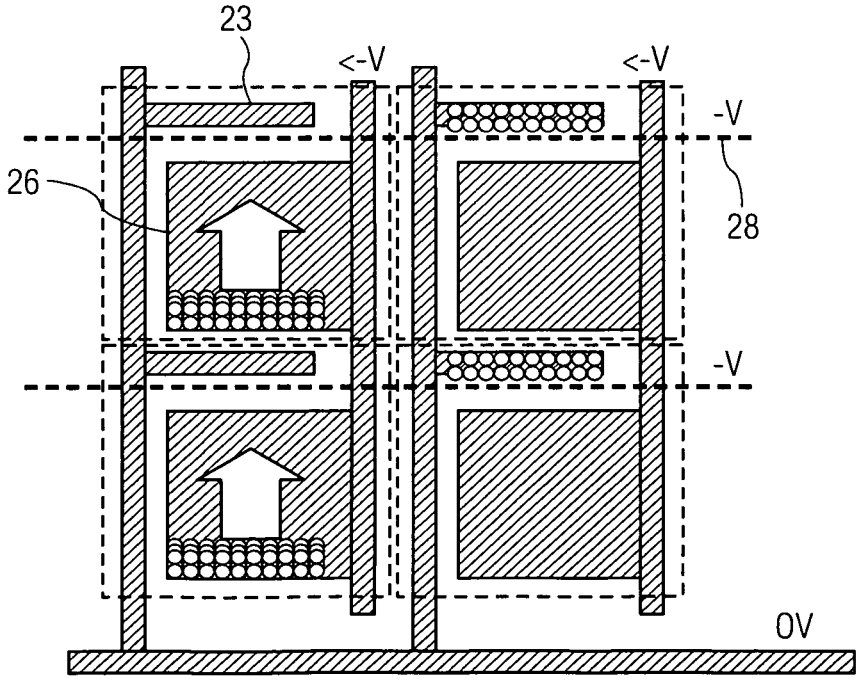

As shown in FIG. 7, a "post pulse" is added to the display driving scheme, and which involves applying a new voltage to all pixel electrodes at once.

This post pulse is applied after all pixels in the display have been addressed, with the voltage of all gate electrodes set to the non-select voltage (−V) and held at this value long enough that all particles in all pixels are accumulated at the edge of the pixel electrode furthest away from the gate electrode. This is the situation shown in FIG. 6.

At this point, all pixel electrodes are brought to a voltage lower than the non-select voltage (<−V), which causes the particles to move back towards the gate electrode, as shown in FIG. 7.

Figure 8:
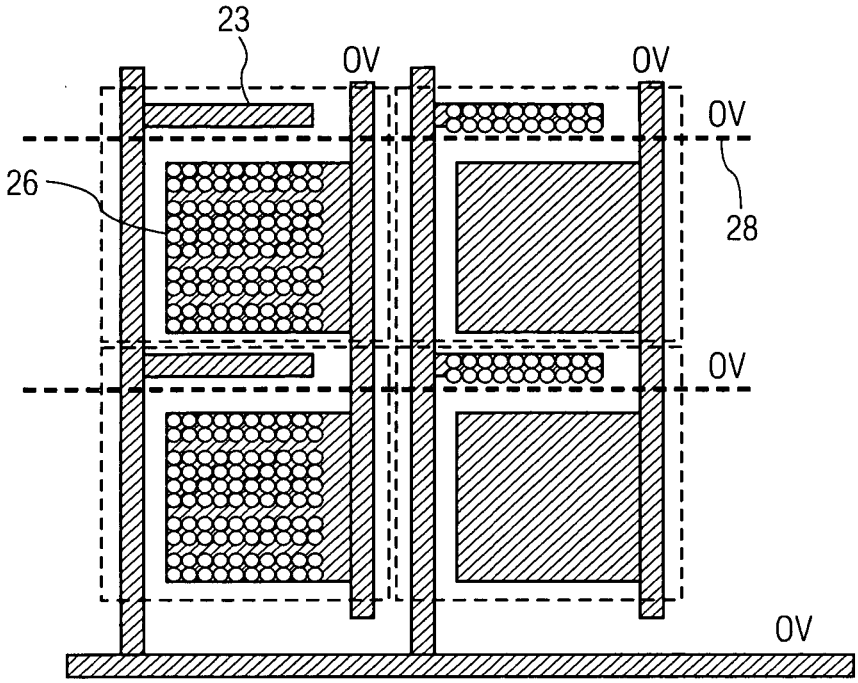

After a fixed period of time (which is the same for all pixels), the particles uniformly fill the pixels, at which point all electrode voltages are removed and the image remains visible (due to the bistability of the particles). This stable end state is shown in FIG. 8.

The addressing method thus comprises:

a reset phase, in which control signals are applied to all pixels such that the particles in each pixel move towards the reservoir electrodes 23 (these may be considered to be first drive electrodes);

a pixel data loading (i.e. addressing) phase, in which control signals are applied to rows of pixels in turn, such that the particles in each pixel are selected either to stay in the vicinity of the first drive electrode (the reservoir electrode 23) or move to the pixel electrode 26;

a drive phase, in which control signals are applied to all pixels for distributing the particles which have moved to the pixel electrode more uniformly over the pixel electrode. This drive phase is implemented by the "post pulse".

The method has been described in connection with a simple pixel layout. Improved performance can be obtained with more complicated pixel layouts, and a second aspect of the invention uses a modified pixel design, shown in FIG. 9. This modified pixel design forms an aspect of this invention.

Figure 9:
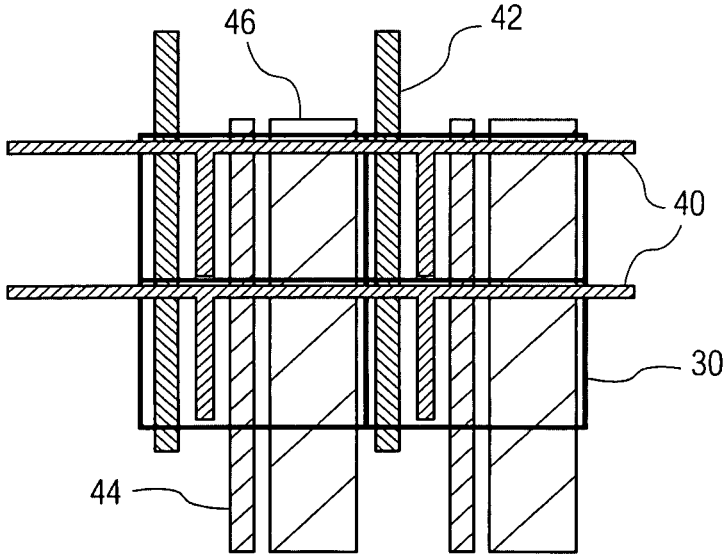
FIG. 9 shows a pixel layout of the invention for a second method of operation of the invention.

As shown in FIG. 9, each pixel has four electrodes. Two of these are for uniquely identifying each pixel, in the form of a row select line electrode 40 and a write column electrode 42. In addition, there is a temporary storage electrode 44 and the pixel electrode 46.

In this design, the pixel is again designed to provide movement of particles between the vicinity of the control electrodes 40,42 and the pixel electrodes 46, but an intermediate electrode 44 is provided, which acts as a temporary storage reservoir. This allows the transfer distance during the line-by-line addressing to be reduced, and the larger transfer distance from the temporary electrode 44 to the pixel electrodes 46 can be performed in parallel. FIG. 9 again shows the pixel areas as 30.

Figure 10:
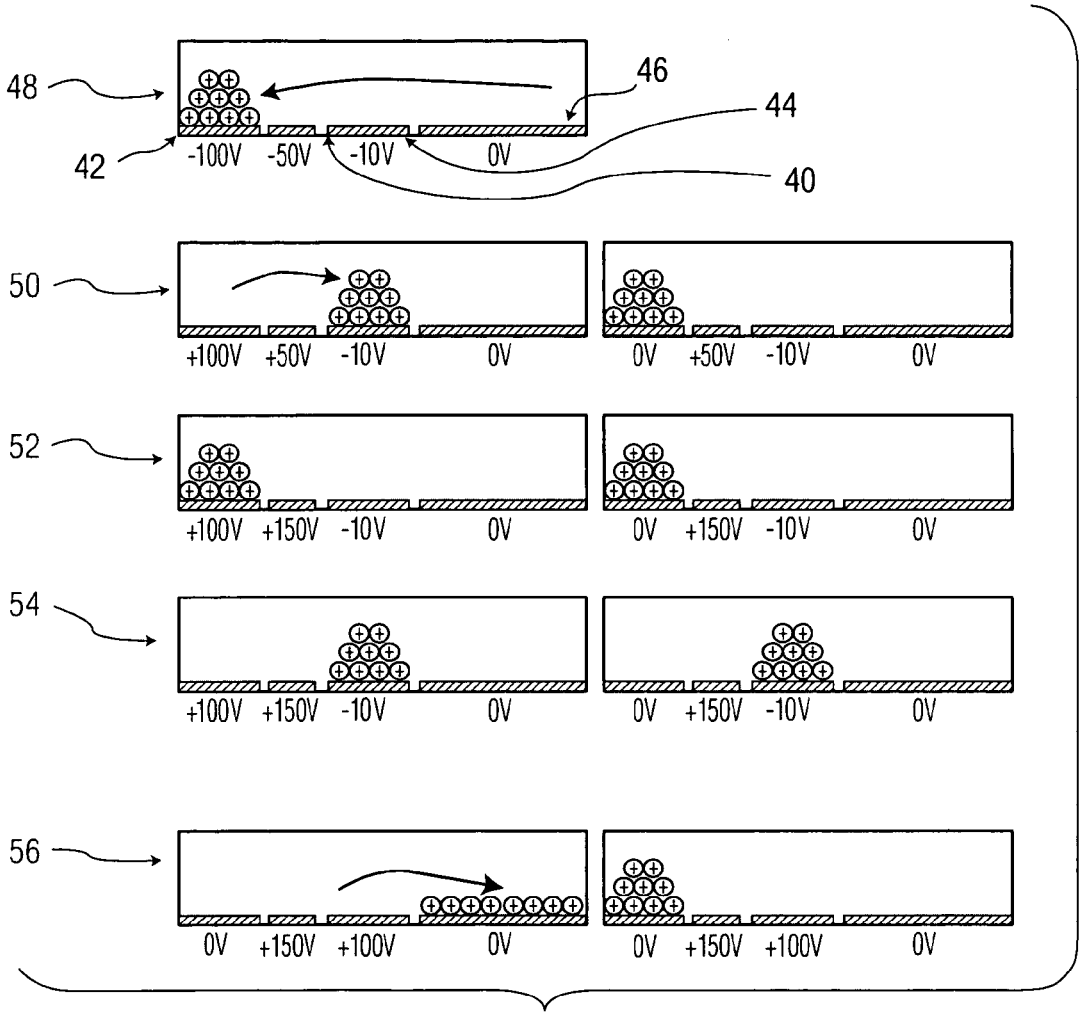
FIG. 10 is used to explain the operation of the pixel layout of FIG. 9.

FIG. 10 is used to explain the operation of the pixel layout of FIG. 9 using a second version of the method of the invention. However, the method again comprises the three steps of reset, addressing and drive, as explained above.

FIG. 10 shows the voltages applied to the four electrodes of each pixel. The column data electrode 42 can be considered to be a first drive electrode, the row select electrode 40 can be considered to be a second drive electrode, and the temporary storage electrode 44 is between the first and second drive electrodes on one side and the pixel electrode 46 on the opposite side.

FIG. 10 assumes the use of positive particles.

The temporary storage electrode 44 is at a fixed voltage for the duration of the addressing phase, of −10V in this example, and does not need to be driven with control voltages as such during addressing. However, it is used for the final drive phase as explained below. Similarly, the pixel electrodes 46 can remain fixed at 0V (for all phases of the scheme).

The reset phase proceeds as above, and brings all particles to the reservoir, in the form of the first drive electrodes, which are the column data electrodes 42. This is achieved by brining the data electrodes to a low voltage, −100V in this example, and lower than the select line voltage so that all pixels migrate to the data electrodes 42 as shown in the top figure. The image 48 shows the particle distribution in the reset phase.

For the rows of images 50,52,54,56 (each discussed below) the left column represents the effect on pixels to be written and the right column shows the effect on pixels which are not to be written.

The row of images 50 represents selected rows and shows the particle distribution in the selected row of pixels. The selection of the row of pixels is reflected by the selection electrode voltage 40 of 50V, whereas the non-select voltage is 150V.

If a pixel is to be written, the voltage on the column data line 42 is 100V and if it is not to be written, the voltage on the column data line is 0V.

As shown, for a pixel to be written, the particles move to the temporary storage electrode 44 which has the lowest voltage, and there are no voltage barriers to the movement from the electrode 42 to the temporary storage electrode. For a pixel which is not to be written, the column data line voltage remains at 0V, and the select line voltage of 50V acts as a barrier to the movement of particles from the electrode 42 to the temporary storage electrode 44.

The row of images 52 represents other rows which are already written off, and again shows the particle distribution in those rows of pixels which have been reached by the addressing phase and have been driven to off. The high row select line voltage of 150V again acts as a barrier preventing the particles moving out of the reservoir.

Similarly, (although not shown) rows of pixels which have not yet been addressed are unaffected by the addressing of preceding rows, and the particles remain in the reservoir.

The row of images 54 represents other rows which are already written on, and again shows the particle distribution in those rows which have already been reached by the addressing phase and driven to the on state. It shows that other rows which have been driven to the write condition (with the particles on the temporary storage electrode 44) are not disturbed by the subsequent addressing of other rows. The temporary electrode is at the lowest voltage, and once particles have been moved to the temporary electrode, they remain there.

The "addressing" period can proceed faster, due to the fact that the distance to travel is reduced and the particle velocity is increased due to increased electric field (also as a result of the shorter electrode distance given equal applied voltages).

The end result, after all lines have been selected in the "addressing" period, is that the particles of a pixel are either located on the first drive electrode, namely the column data electrode 42 (non written pixels) or on the temporary storage electrode 44 (written pixels). Thus, the addressing moves written pixels towards the pixel electrode, but only as far as the temporary storage electrode.

Then, in the final drive phase 56 (the bottom set of images), only the particles that have been put in place on the temporary storage electrode will be transported further to the pixel electrode. This final drive phase shows the particle distribution for either the written (left column) or non-written case (right column).

The potential on the temporary storage electrode is used for this driving phase, and is raised to +100V, so that the particles move to the 0V pixel electrode. The select line electrodes 40 at 150V again act as a barrier to prevent movement of particles at the reservoir electrodes 42 (which are in any case now at 0V).

The additional temporary storage electrode does not significantly increase of the costs of the driver electronics, as this electrode is common for all pixels. Therefore, a single additional connection to the driving electronics is required.

The electrodes can all be at the same physical height, as the electric potentials provide suitable barriers to the movement of particles, when required.

After the driving phase in FIG. 10, the voltages (as shown) are kept on the electrodes, and all particles will remain fixed due to the applied potentials. The written particles will remain at the pixel electrode, and the non written pixels on the first drive electrode (the column data electrodes). The second drive electrodes (row select electrodes) and temporary storage electrodes form an electrical barrier to fixate the particles at their locations. This is the situation assuming that the particles are of a highly diffusive nature (for instance particles with a radius of less than 100 nm). In general, it is possible that the distribution is not nicely uniform over the pixel electrode (the problem as discussed referring to FIG. 6). In that case the driving phase can include an additional post-pulse (as in FIG. 7) to establish a uniform particle distribution.

Figure 11:
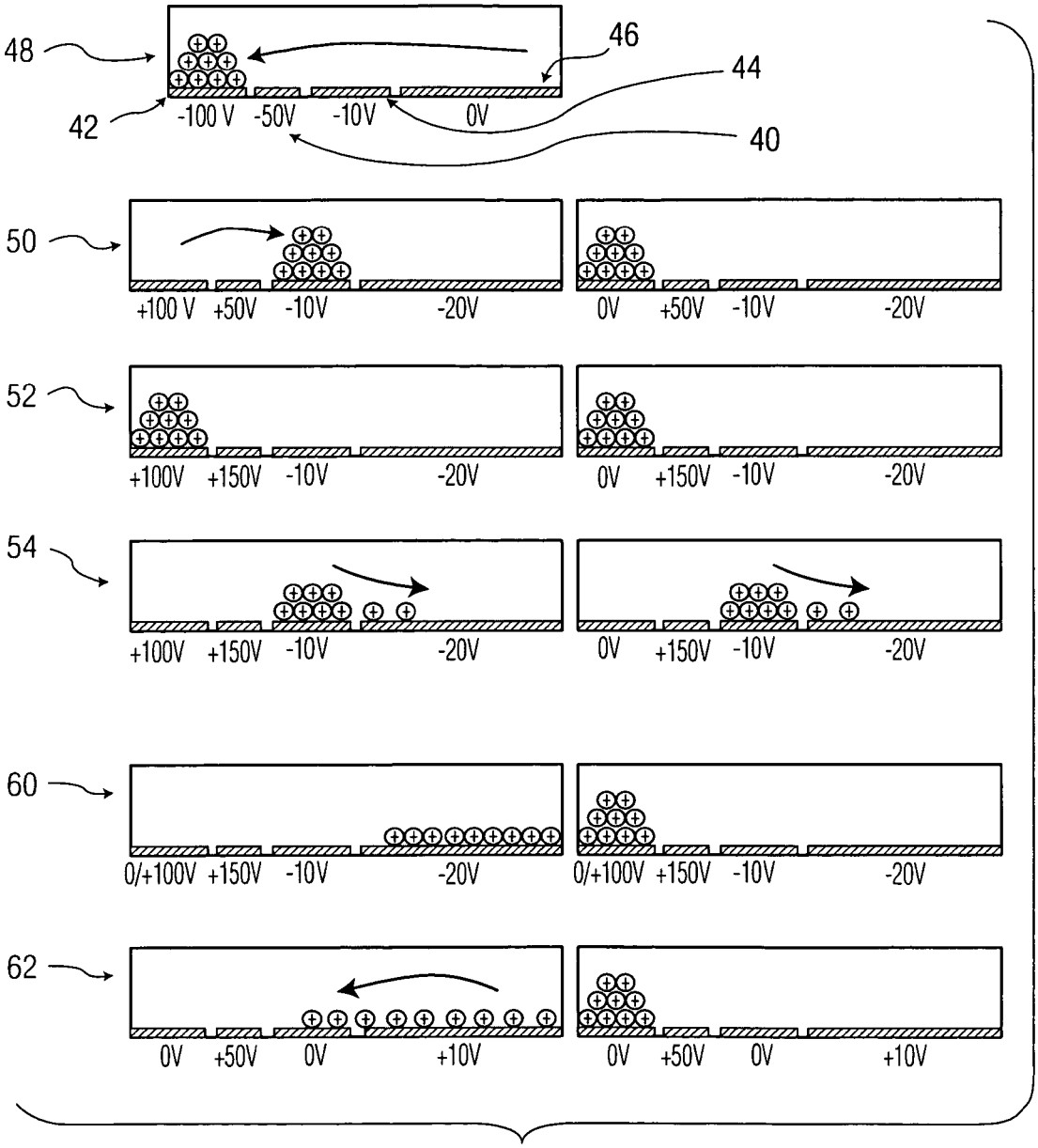
FIG. 11 is used to explain an alternative operation method of the pixel layout of FIG. 9.

Alternatively, the addressing phase can be arranged such that the particles, after being transported to the third (temporary storage) electrode 44 during the line-select time, are transported further to the fourth (pixel) electrode 46 during the remainder of the addressing time. This is shown in FIG. 11. Then, the driving phase can be used to distribute the particles uniformly over both the third and fourth electrodes (enabling better contrast and brightness due to the larger switchable area).

The rows of images 48,50,52 and 54 correspond to those in FIG. 10. The only difference for these conditions is that the pixel electrode is at −20V rather than at 0V. The implication of this is that for a row which is already written on, the particles can already start to move to the pixel electrode as shown in the row of images 54. Thus, the particles are not held on the temporary storage electrode 44 during the addressing time.

At the end of the addressing phase, shown as row of images 60, the particles have already moved to the pixel electrode.

The driving phase, shown as images 62 causes the particles to be spread over both the temporary storage electrode 44 and the pixel electrode 46, to improve contrast and brightness, as outlined above. The voltages on the four electrodes are selected to provide the required uniform distribution, and as shown, the temporary storage electrode is brought to a voltage slightly below that of the pixel electrode, and the barrier created by the select line electrode 40 is also reduced.

Greyscales can also be implemented. For example for 4 (=2 bit) grey levels, the driving scheme can consist of 4 periods: one "reset" period, two "addressing" periods (one with ⅔ of the transit time and the other with ⅓) and one driving period.

The line-times in the two addressing periods are set shorter than the transit times of the particles. This means that not all particles are transferred to the temporary storage electrode, but only a fraction roughly proportional to the fraction of the transit time. During the first addressing period the pixels with 66% and 100% desired output setting will be driven to the "write" mode, and during the second addressing period the pixels with desired output setting of 33% and 100% will be driven to the "write" mode.

Pixels can be written a second time, because in the second addressing phase (not shown in FIG. 10 or FIG. 11) the particles have already been written to the temporary storage electrode during the first addressing period is not disturbed by a second "write" or "non write" addressing phase.

In general, greyscales can also be written by varying either the duration or the amplitude of the writing voltages of individual pixels during a single addressing period, namely varying the voltage amplitude or duration on electrode 42.

In the driving phase, the particles of the temporary storage electrode are transported to the pixel electrodes. For different pixels the quantity of particles will be different (depending on whether they were written during the first or second addressing period or during both). The different quantity of particles on the pixel electrode will then result in a different optical appearance (for instance by absorption or scattering).

The addressing method thus comprises:

a reset phase, in which control signals are applied to all pixels such that the particles in each pixel move towards the reservoir electrodes 42 (these may again be considered to be first drive electrodes and are the column data electrodes);

a pixel data loading (i.e. addressing) phase, in which control signals are applied to rows of pixels in turn, such that the particles in each pixel are selected either to stay in the vicinity of the first drive electrode 42 or move towards the pixel electrode 46, but only as far as the temporary storage electrodes 44;

a drive phase, in which control signals are applied to all pixels for moving the particles which have moved to the temporary storage electrode to the pixel electrode.

In a third aspect of the invention, passive matrix addressing can be carried out without using a gate electrode, but by using a threshold (non-linearity) in the electro-optical response of the electrophoretic liquid.

The use of so-called threshold addressing for electrophoretic displays has been proposed, and enables a simplification of the drive scheme and/or hardware. Examples of threshold addressing schemes can be found in U.S. Pat. No. 6,693,620. As described in detail in that document, the threshold voltage response can be obtained by appropriate selection of the material of the electrophoretic particles and/or the medium in which they are suspended.

Figure 12:
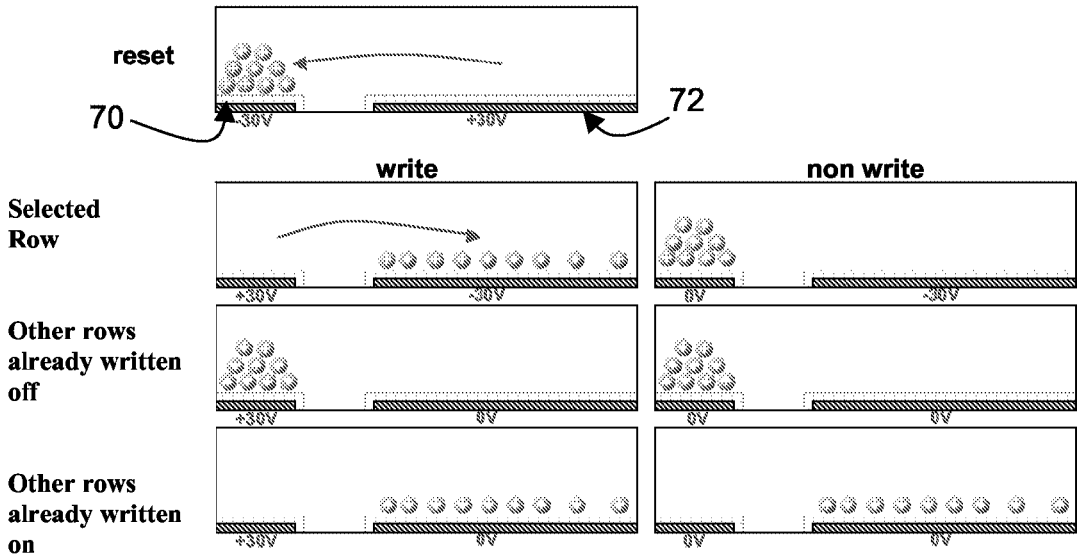
FIG. 12 shows a different type of pixel design which has been proposed by the applicant.

An example of passive matrix driving scheme using a threshold, which has been proposed by the applicant, is given in FIG. 12. The threshold is represented schematically as a different electrode design, simply to distinguish over the previous figures.

In this example, a threshold of 40V is assumed to be realised, below which the particles in the liquid do not experience the electric fields at all. The particles are shown as positively charged.

In the proposed drive scheme, a "reset" phase is used where the particles are collected on the first drive electrode 70, which is the column data electrode, simultaneously in all pixels of the display.

Then in the "addressing" period, line-after-line, the particles are transferred to the pixel electrode 72 for the desired "written" pixels. Selection of a line occurs by lowering its voltage from 0V to −30V on a line which connects to the pixel electrodes. Writing a column occurs by increasing its voltage from 0V to +30V on the column data electrode 70. Only in those pixels that lie in the intersection of a line that is selected and a column that is written, particles are transported as the voltage difference between both electrodes then exceeds the 40V threshold. In all other pixels the particles remain undisturbed, because the potentials are not sufficient to exceed the threshold.

This proposed pixel arrangement and drive scheme can also be modified using the teaching of this invention, as will be explained with reference to FIG. 13, which is used to explain a third aspect of the invention The modification to the pixel design again introduces an additional electrode, and the modification to the drive scheme introduces an additional driving phase.

Figure 13:
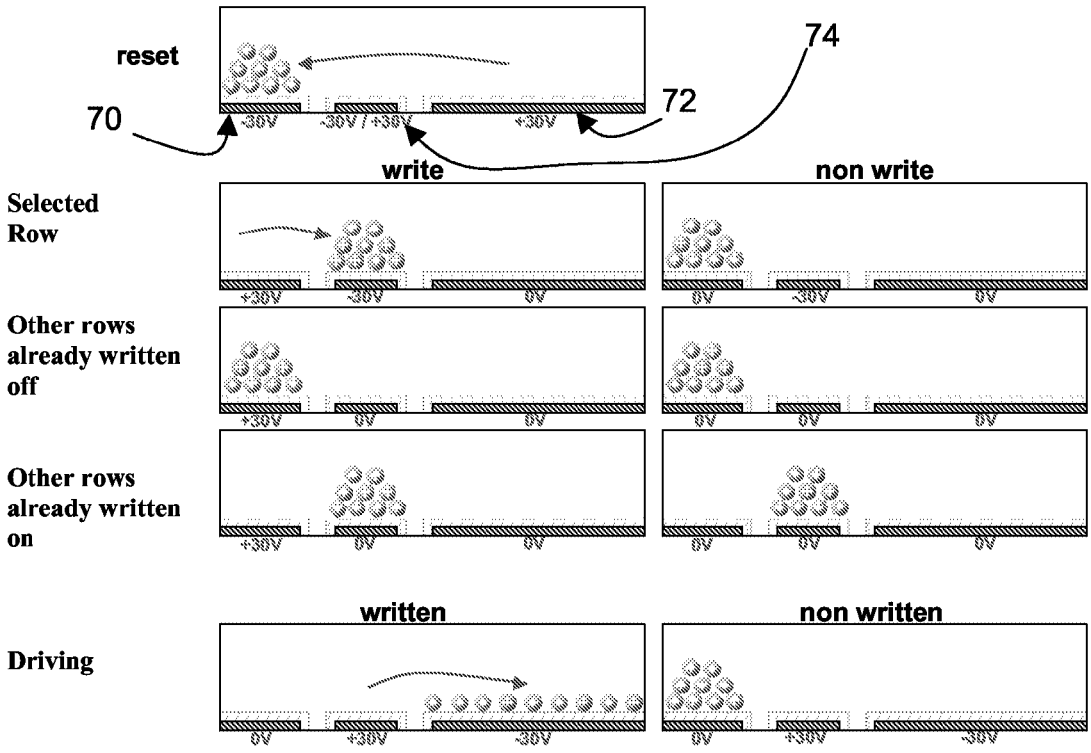
FIG. 13 shows a modification to the layout of FIG. 12 in accordance with the invention and is used to explain a method of operating the pixel in accordance with the invention.

As shown in FIG. 13, the additional common electrode 74 is added between the first drive electrode 70 and the pixel electrode 72, and acts as a temporary storage electrode (this may be considered as a second drive electrode, so that the pixel arrangement comprises first and second drive electrodes and the pixel electrode).

The "reset" phase proceeds in the same way as described above, with the particles being biased to the column data electrodes 52. However, this proceeds in two steps. The first step is to collect all particles (which were previously on the pixel electrodes 54 or on the temporary storage electrodes 56) onto the temporary storage electrodes 56, by placing −30V, −30V, +30V respectively on the three electrodes 52,56,54. The second step is to collect all particles on the first, data electrode 52 by placing −30V, +30V, +30V respectively on the three electrodes 52,56,54.

The "addressing" period also proceeds in similar manner to that explained above. The pixel electrode 72 is kept at 0V and is not involved in the driving during the addressing period. This electrode can be implemented by a single connection to the driving electronics (shared by all pixels).

FIG. 13 shows similar plots to those of FIG. 10, and indeed the use of the temporary storage electrode is analogous, but the threshold arrangement avoids the need for the gate electrode of FIGS. 9 and 10.

In the driving phase, for all pixels simultaneously, the particles on the first drive electrode 70 (the column data electrode) remain there, while the particles collected on the temporary storage electrode 74 are transported to the pixel electrode. The pixel electrode is the largest of all three electrodes, in area. This ensures that the aperture ratio, which defines the active area of the display that can actually modulate intensity, is maximum. It also ensures that the gain in speed is also maximum, because then the largest part of the in-plane distance is covered in the driving phase period.

During the "addressing" period it is desirable that the diffusion of the particles is as small as possible. Particularly, the time it takes for the particles to diffuse back from the temporary storage electrode 74 to the first electrode 70 should be larger than the total time of the "addressing" period. This will be clear from FIG. 13, which shows that once a row has been written, each time the column is set to the non-write voltage of 0V, the first electrode and the temporary storage electrode are adjacent each other with the same voltage applied. One way to realise this diffusion barrier is by using particles with a high charge per particle.

In particular, the time it takes to transfer particles electrically is inversely proportional to the mobility of the particles. The time it takes for particles to diffuse back is inversely proportional to the diffusion constant of the particles. Therefore the ratio between both timescales equals the ratio between mobility and diffusion constant. This latter ratio is independent of particle size, but only depends on the particle charge (Einstein's law).

After the driving phase, it is possible to keep the particles at their positions by keeping the voltages applied on the electrodes (as described above). For instance the voltages on the first drive electrode and the pixel electrodes can be set to 0V, while the temporary storage electrode provides a barrier, with the voltage exceeding the threshold of +40V.

Alternatively, it is beneficial for both the "addressing" and after the "driving" that the electrophoretic liquid is bistable. Then, all voltages can be removed from the electrodes and power consumption will be zero after the image is written in.

Figure 14:
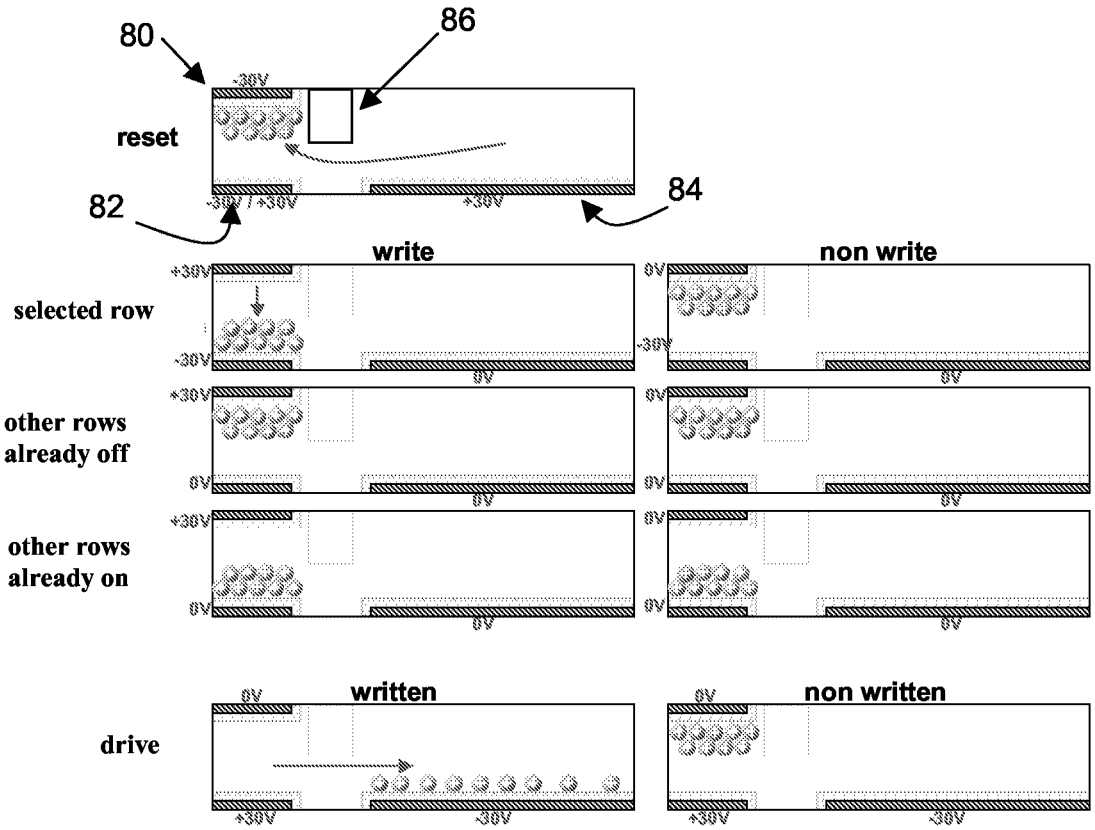
FIG. 14 shows a modification to the layout of FIG. 13 which is operated in similar manner.

The addressing period will be faster as the distance reduces that the particles have to travel in that period. The greatest gain in speed can be achieved if the addressing takes place in a top-down direction. A fourth aspect of the invention using this approach is shown in FIG. 14.

The driving method corresponds to that explained with reference to FIG. 13. However, the pixel is arranged with a top electrode 80 which is the first drive electrode and is the column data line, a bottom electrode 82 which is the temporary storage electrode, and a larger bottom electrode 84 which is the pixel electrode.

The "reset" period proceeds as explained above, in two steps, first collecting at the temporary storage electrode 82, then on the first drive electrode 80. The temporary storage electrode is again effectively between the other two electrodes, as the temporary storage electrode faces the first drive electrode in one direction (upwardly) and faces the pixel electrode in another direction (sideways).

The "addressing" period also proceeds as explained above. Again, the pixel electrode is not involved. The gain in addressing speed is increased significantly since the distance to travel per line is equal to the height of the pixel volume, which in realistic examples can as small as 4-10 microns compared to the 500 microns lateral pixel size.

In the driving phase, only the particles on the temporary storage electrode 82 should be transported to the pixel electrode. However, in this case, the temporary storage electrode cannot act as an effective electrical barrier between the first drive electrode 80 and the pixel electrode 84, as it is no longer directly between the first drive electrode 80 and the pixel electrode 84.

Instead, one preferred method to realise the barrier is by inserting a structural (mechanical) barrier 86 on the upper side of the pixel volume that prevents the in-plane transport for particles collected on the first electrode 80. Other barrier types are possible, including electrical barriers. For example a permanent electrical barrier may be created by an additional electrode.

The third and fourth aspects above are generally applicable for electrophoretic displays where the electro-optical response shows non-linearity (or even better, a threshold). There are different ways to implement a threshold which will be apparent to those skilled in the art.

The image update time in this aspect can be reduced very considerably, for example to the order of hundreds of seconds. In all aspects, it can be advantageous for the particles to show bistability.

Electrophoretic display systems can form the basis of a variety of applications where information may be displayed, for example in the form of information signs, public transport signs, advertising posters, pricing labels, billboards etc. In addition, they may be used where a changing non-information surface is required, such as wallpaper with a changing pattern or colour, especially if the surface requires a paper like appearance.

The physical design of the pixels has not been described in detail, as this will be known to those skilled in the art.

In the examples above, the electrodes are all on the same substrate. However, different electrodes can be on different substrates. For example, in the pixel data loading phase, the particles which move to the temporary storage electrode can be arranged to move perpendicularly to the plane of the display surface, and in the drive phase the pixels which move to the pixel electrode can move parallel to the plane of the display surface. This enables the line-by-line addressing to be made as short as possible, as the distance of movement is limited to the thickness of the electro-optic material layer.

Thus, the term "faces" should be understood in this context. In particular, the term "face" may indicate a side-by-side arrangement of electrodes, so that one electrode faces another in a sideways direction, or it may indicate a top-bottom arrangement, perpendicular to the substrate planes, so that one electrode faces another in an upward/downward direction. The temporary storage electrode facing the first drive electrode in one direction and facing the pixel electrode in another direction may thus provide a line of the three electrodes or it may provide an "L" configuration.

As will be apparent from the above, there are numerous types of particles, both positively and negatively charged, which can be used. The voltages given are only an example for the particular particle type used in the particular example, and many variations are of course possible.

Various other modifications will be apparent to those skilled in the art.

Finally, the above-discussion is intended to be merely illustrative of the present invention and should not be construed as limiting the appended claims to any particular embodiment or group of embodiments. Each of the systems utilized may also be utilized in conjunction with further systems. Thus, while the present invention has been described in particular detail with reference to specific exemplary embodiments thereof, it should also be appreciated that numerous modifications and changes may be made thereto without departing from the broader and intended spirit and scope of the invention as set forth in the claims that follow. The specification and drawings are accordingly to be regarded in an illustrative manner and are not intended to limit the scope of the appended claims.

In interpreting the appended claims, it should be understood that:

a) the word "comprising" does not exclude the presence of other elements or acts than those listed in a given claim;
b) the word "a" or "an" preceding an element does not exclude the presence of a plurality of such elements;
c) any reference numerals in the claims are for illustration purposes only and do not limit their protective scope;
d) several "means" may be represented by the same item or hardware or software implemented structure or function; and e) each of the disclosed elements may be comprised of hardware portions (e.g., discrete electronic circuitry), software portions (e.g., computer programming), or any combination thereof.

The invention claimed is:

1. A drive method for a display device, the display device comprising an array of rows and columns of pixels disposed over a common substrate, wherein each pixel comprises at least a first drive electrode, a second drive electrode and a pixel electrode, and wherein the display characteristics of each pixel are altered by controlling the movement of charged particles within the pixel area under the influence of control signals applied to the first and second drive electrodes and the pixel electrode, wherein the method comprises:

in a reset phase, applying control signals to all pixels such that the particles in each pixel move towards the first drive electrode;

in a pixel data loading phase, applying control signals to a row of pixels via said second drive electrode or a column of pixels via said first drive electrode in turn, such that the particles in each pixel are selected either to stay in the vicinity of the first drive electrode or move towards the pixel electrode, wherein each pixel further comprises a temporary storage electrode with the first and second drive electrodes on one side and the pixel electrode on an opposite side, and wherein in this pixel data loading phase the particles in each pixel are selected either to stay in the vicinity of the first drive electrode or move to the temporary storage electrode, which is closer to the pixel electrode;

in a drive phase, applying control signals to all pixels for distributing the particles which have moved towards the pixel electrode over the pixel electrode, wherein in this drive phase the pixels in the vicinity of the temporary storage electrode are moved to the pixel electrode.

2. A method as claimed in claim 1, wherein in the pixel data loading phase, the particles in each pixel are selected either to stay in the vicinity of the first drive electrode or move to the pixel electrode, and wherein in the drive phase the uniformity of the distribution of the particles which are in the vicinity of the pixel electrode is increased.

3. A method as claimed in claim 1, wherein in the drive phase, a signal is applied to the second drive electrode to substantially prevent the movement of particles from the temporary storage electrode to the first drive electrode.

4. A method as claimed in claim 1, wherein in the drive phase, a signal is applied to the second drive electrode which substantially prevents the movement of particles from the first drive electrode to the pixel electrode.

5. A method as claimed in claim 1, wherein the pixel data loading phase comprises multiple sub-phases for implementing partial movement of particles to provide grey scale operation.

6. A method as claimed in claim 1, wherein the pixel data loading phase comprises data signals of variable amplitude and/or duration for implementing partial movement of particles to provide grey scale operation.

7. A device as claimed in claim 6, comprising an electrophoretic passive matrix display device.

* * * * *